US005426487A

United States Patent [19]

Stelter et al.

[11] Patent Number: 5,426,487

[45] Date of Patent: Jun. 20, 1995

[54] IMAGE FORMING APPARATUS HAVING BIMODAL CHARGING MEANS

[75] Inventors: Eric C. Stelter, Rochester; Joseph E. Guth, Holley, both of N.Y.

[73] Assignee: Eastman Kodak Company, Rochester, N.Y.

[21] Appl. No.: 134,311

[22] Filed: Oct. 8, 1993

[51] Int. Cl.[6] ..... G03G 15/02

[52] U.S. Cl. ..... 355/219; 355/215; 355/221; 355/326 R

[58] Field of Search ..... 355/215, 219, 225, 326 R, 355/221, 222, 223; 250/324–325; 430/122, 45

[56] References Cited

U.S. PATENT DOCUMENTS 4,791,452 12/1988 Kasai et al. ..... 355/219 X 5,001,028 3/1991 Mosehauer et al. ..... 430/45

5,181,072 1/1993 Furuya et al. ..... 355/225

*Primary Examiner*—Robert B. Beatty

*Assistant Examiner*—Shuk Y. Lee

*Attorney, Agent, or Firm*—Leonard W. Treash

[57] ABSTRACT

An image forming apparatus includes an image member which moves through a path past a series of stations. The series of stations create both first and second toner images on the same frame of the image member which images can be of different color. When the apparatus is used to form single color images, a charging station used in creating the second toner image is turned to a standby condition. In the standby condition, a bias is maintained on the charging station to repel toner particles from the first toner image that might otherwise accumulate on the charging station.

2 Claims, 2 Drawing Sheets

IMAGE FORMING APPARATUS HAVING BIMODAL CHARGING MEANS

This invention relates to image forming apparatus in which a toner image is formed on an image member. Although not limited thereto, it is particularly usable in such apparatus in which an electrostatic image is formed on an image member already containing a loose toner image.

U.S. Pat. No. 5,001,028 to Mosehauer et al is representative of a number of references describing a process in which a photoconductive image member is uniformly charged and imagewise exposed to create an electrostatic image. Toner is applied to the electrostatic image to create a toner image. Usually, in this process, discharged area development is used. Thus, the toner applied is of the same polarity as the electrostatic image. It deposits in the areas of lowest charge (the discharged areas) to form a toner image having a density which is greatest in the portions of the image receiving the greatest exposure.

The image member is, again, uniformly charged with a charge of the same polarity as the original charge. It is, again, imagewise exposed to form a second electrostatic image, generally in the portions of the image member not covered by the first toner image. The second electrostatic image is toned, again, with a toner of the same polarity as the electrostatic charge to create a second toner image. If the two toner images are formed with toners of different color, a two color image is produced. The process can be repeated with a third electrostatic image toned by a third color toner to create a three color image, etc. The two color image is transferred in a single step to a receiving sheet and fused also in a single step.

Although the process is not necessarily limited to such applications, it is most commonly used to provide accent color prints or copies with laser or LED printhead electronic exposure. All commercial applications known to us use electronic exposure and discharged area development.

The process has a number of advantages in accent color applications. It eliminates the troublesome and expensive steps usually used in registering images at transfer. Prior commercial applications use the same charger and exposure station for creating each of the electrostatic images. However, in the image forming apparatus shown in the Mosehauer reference, a separate charging station and exposure station is used for each electrostatic image. This feature permits the formation of accent color images at the same speed as single color images.

SUMMARY OF THE INVENTION

When providing accent color at full machine speed employing a separate charging and exposing station, a particular problem was encountered. For reasons associated with image formation, the black station was positioned first because the apparatus was often asked to provide nothing but black images for extended periods of time between uses of the accent color feature. The accent color charger was turned off during this mode. Unfortunately, it showed a tendency to attract some of the toner associated with the black toner image passing at close proximity to it. This ultimately interferes with the functioning of the charger and reliability of the apparatus.

According to the invention, we have solved this problem by providing a means for applying a bias to the charging means, which bias is of the same polarity as that of the toner particles to prevent attraction of toner particles from the toner image.

Although this invention has been primarily designed for use in an image forming apparatus of the Mosehauer type, it is applicable in any instance in which a toner image passes in close proximity to an otherwise turned off charger.

DESCRIPTION OF THE PREFERRED EMBODIMENTS

Figure 1:
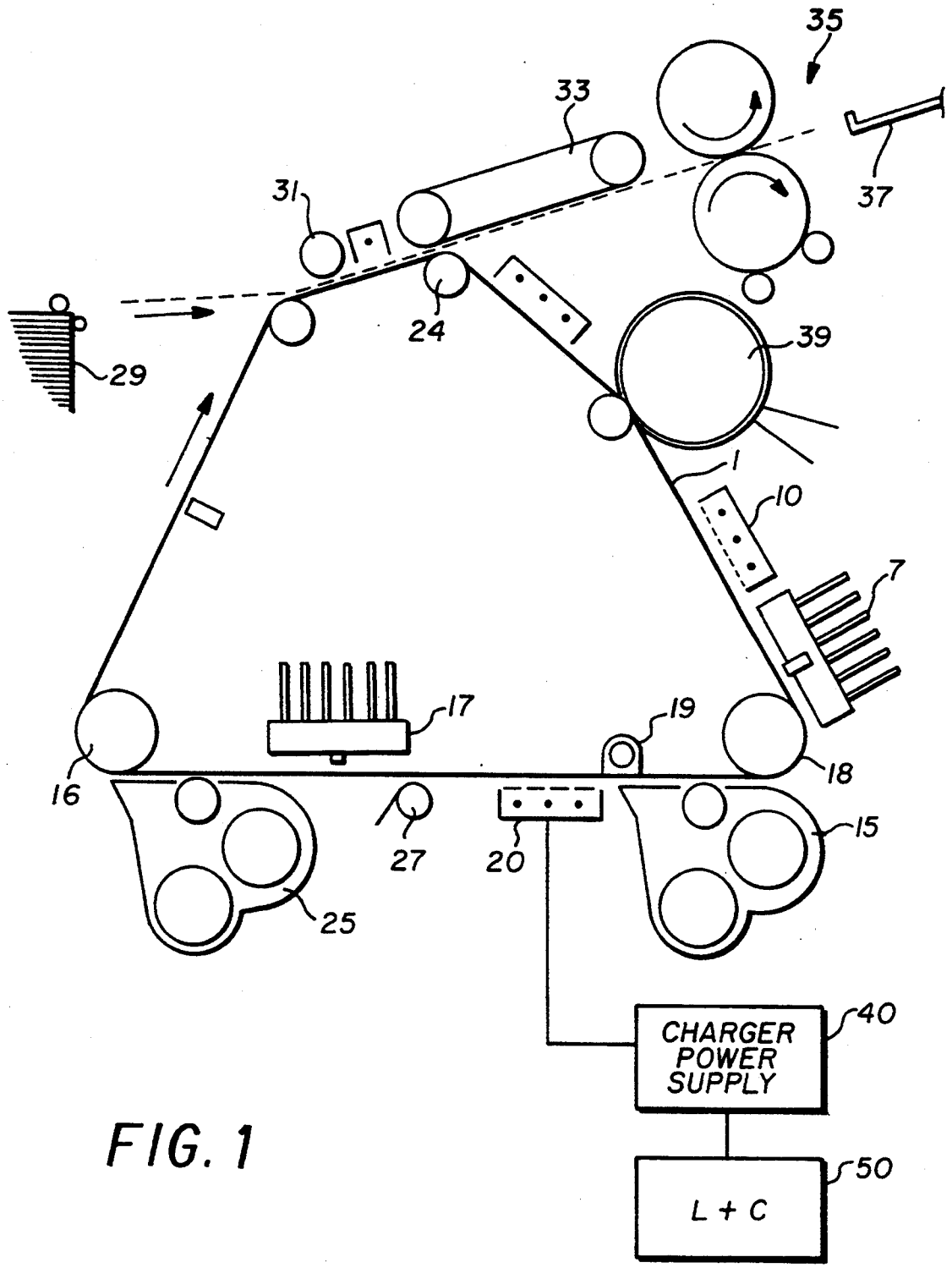
FIG. 1 is a side schematic of an image forming apparatus.

FIG. 1 shows an image forming apparatus for producing two color images in a single frame. According to FIG. 1, an image member 1 is in the form of an endless belt trained about a series of rollers, including tension roller 16 and a drive roller 18, to continuously move through a series of electrophotographic stations well known in the art. Image member 1 is charged by a first charging device 10 to a uniform potential, for example, a negative potential. It is imagewise exposed by an exposure device, for example, a first LED printhead 7 to create a first electrostatic image. The first electrostatic image is toned at a first toning station 15 by the application of toner having a polarity the same as the original charging station 10, for example, a negative polarity. Toner is, thus, applied to the areas discharged by exposure station 7.

The image member is recharged by a second or additional charging station 20 which evens up the charge of the first polarity on the image member at a predetermined level. This level need not be the same as the charge applied by station 10. However, before recharging, the image member is exposed to overall blanket radiation through its support by erase lamp 19. This causes the toner to be more firmly held to the image member, despite charge from the charging station 20. A magnetic scavenger 27 attracts any carrier inadvertently picked up by the image member in the first toning step.

Image member 1 is then imagewise exposed by a second exposure station, for example, a second LED printhead 17 which can be positioned inside the image member 1 and exposes image member 1 through a transparent support to create the second electrostatic image. The second electrostatic image is toned by a second toning station 25 which applies toner, preferably of a color different than that applied by station 15 to create a second toner image on the image member, thereby forming a two color or multicolor image on the image member.

A receiving sheet is fed from a receiving sheet supply 29 into overlying contact with the two color toner image. The two color toner image is transferred to the receiving sheet at a conventional biased roller electrostatic transfer station 31, and the receiving sheet separates from the image member as the image member goes around a small roller 24. The receiving sheet is transported by a vacuum transport 33 to a fuser 35 where the two color image is fixed to the receiving sheet. The receiving sheet is ultimately deposited in an output tray 37. The image member is cleaned by a cleaning device 39 so that the process can be continued.

This apparatus doubles the speed of doing two color images, compared to conventional approaches in which the images are formed on separate frames and transferred in registration. It also avoids the complexity of registering two image transfers with attendant complex receiver handling.

The apparatus shown in FIG. 1 can be expanded to include more stations for creating more electrostatic images in the same frame order to form three and four color images. Further, the electrostatic image formed by charging station 20 and exposure station 17 can be toned by toners contained in more than one developing station than just station 25, thereby providing a choice of accent colors to the operator.

Apparatus similar to FIG. 1 can be applied to copiers and printers which are dedicated primarily to multicolor imaging. Such image forming apparatus may operate at modest speed. However, it is also applicable to high volume copiers and printers whose primary use is in the production of black images. The accent color capability then becomes a feature that is used now and then. For both accent color or black images, the process for foraging the black image, starting with reinitialization of the film by the cleaning station and ending with development, is always the same if the first toning station 15 contains black toner and the second toning station 25 (or subsequent stations) contain accent color toners. With such an application, a majority of use of the image forming apparatus involves use of only stations 10, 7 and 15 for forming the first toner image. Stations 20, 17 and 25 are turned off, to be used only when the accent color feature is used. In such a single color mode, the second charging station 20 has a tendency to pick up toner from the continued travel of black toner images in very close proximity to it. This toner may redeposit on a subsequent image frame when the charger 20 is activated or stay on the charger itself, usually forming on the charger's grid. If the toner returns to a subsequent image, it will reduce the quality of that image. If it stays on the grid, it ultimately reduces the reliability of the charger itself.

We have found that these problems can be virtually eliminated by control of a charger power supply 40 by a logic and control unit 50 for the image forming apparatus. More specifically, the charging station 20 has two operational modes. In a first mode or an "on" mode, it applies a charge to image member 1. In a second mode or "standby" mode, no charge is applied. The first mode would be used when multicolor imaging is being carried out, while the second mode would be used when single color imaging with stations 10, 7 and 15 is being carried out.

To prevent the accumulation on station 20 of toner particles from a toner image passing close to station 20 when station 20 is in the "standby" mode, a bias is applied to the station of the same polarity as the charge on the toner particles.

Figure 2:
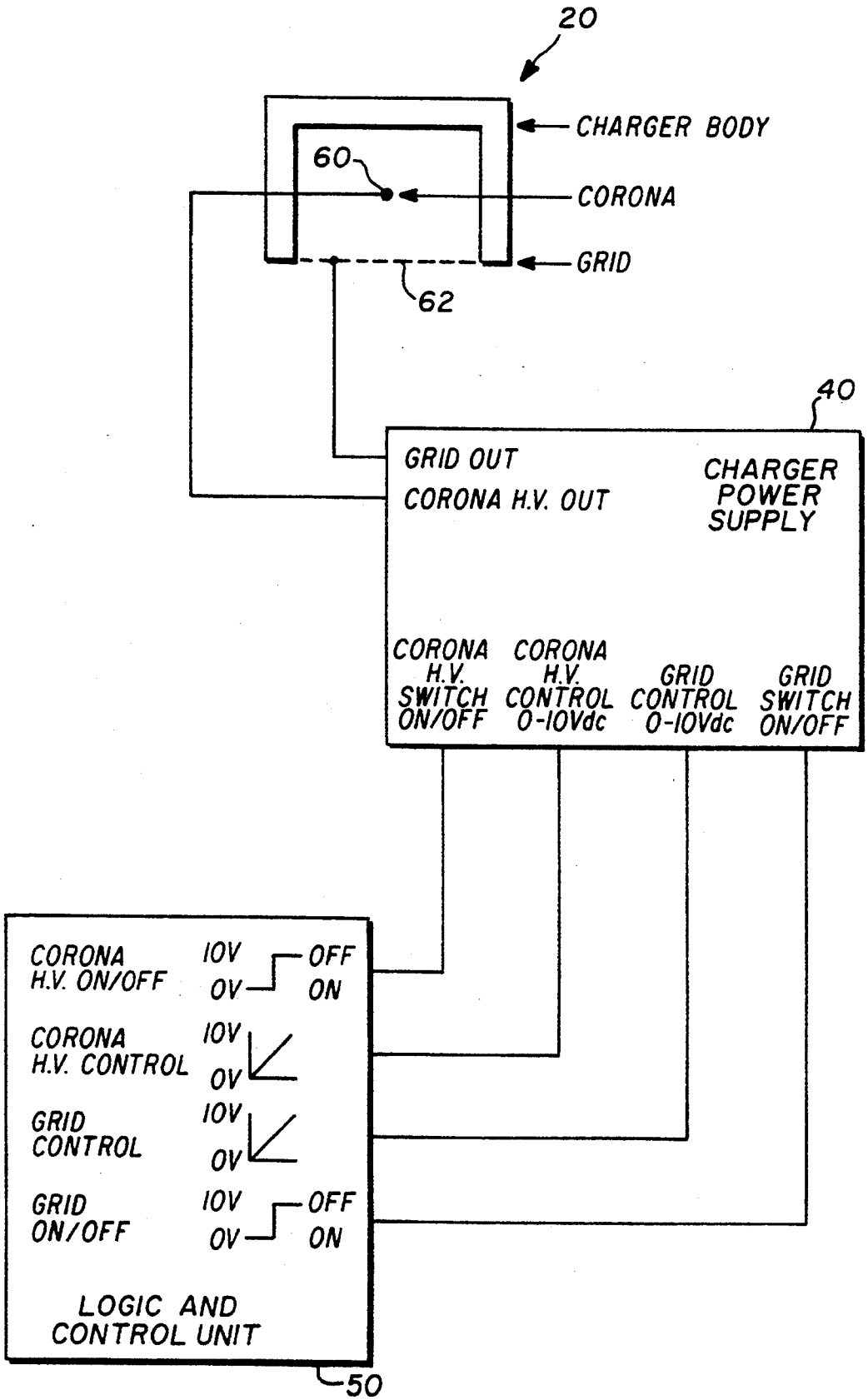
FIG. 2 is a schematic of a charger and its electrical control.

FIG. 2 shows an example of charging station 20 with an appropriate power supply and logic and control unit. According to FIG. 2, charging station 20 includes one or more corona wires 60 and a grid 62. Charger power supply 40 includes a high voltage output connectable to corona wire 60 and a low voltage output connectable to grid 62. When charging station 20 is in the "on" mode, a high voltage output, for example, a voltage in excess of 7,000 volts, is connected to corona wire 60 to generate a corona for application to the image member 1, as it is well known in the art. The level of charge applied to the image member is controlled by a low voltage applied to the grid. For example, a voltage of −600 volts applied to grid 62 will control the charge level on the image member to not be greater than −600 volts.

When only toner image forming stations 10, 7 and 15 are in use, charging station 20 is changed to its "standby" condition or mode. In this mode the high voltage output to corona wire 60 is either turned off or reduced below a level at which corona is generated. However, to prevent the attraction of toner particles from the toner image on image member 1 to charging station 20, a bias is maintained on the grid of a polarity which repels that toner. For example, if a negative charge is applied by both charging stations 10 and 20, and discharged area development is used by toning station 15, the toner particles will be negatively charged. Thus, the bias maintained on the grid 62 during the "standby" mode of charging station 20 would be negative. Thus, a bias of 600 volts could be maintained on the grid both for the "on" condition and the "standby" condition. Alternatively, a lower bias during "standby" on the grid would also be effective in preventing attraction of toner particles to it.

Although grid controlled corona chargers are preferred, it is also known to charge image members without the use of a grid. In such an instance, the high voltage output applied to corona wire 60 should not be completely turned off but should be reduced to a level at which no corona is formed but at which the attraction of toner particles is inhibited. For example, the corona wire, when on, is energized by a high output voltage of 10,000 volts. During "standby", this voltage is reduced, for example, to 500 volts, to inhibit the accumulation of toner particles on the charging station.

The invention can be used in any situation in which a charging station is in "standby" while an unfixed toner image passes in close proximity to it. However, it is of particular use in the image forming apparatus shown in FIG. 1 where it improves the reliability of the second charging station 20.

Note that if charged area development is used by development station 15, the bias applied to station 20 during "standby" would be of a polarity the reverse of that of the corona, which station 20 applies during its "on" condition. Although discharged area development is generally used in an image forming apparatus such as that shown in FIG. 1, a similar process can be successfully employed using charged area development, thereby requiring a reversing power supply for charging station 20.

The invention has been described in detail with particular reference to a preferred embodiment thereof, but it will be understood that variations and modifications can be effected within the spirit and scope of the invention as described hereinabove and as defined in the appended claims.

We claim:

1. Image forming apparatus comprising:

a photoconductive image member, first means for applying a uniform charge of a first polarity to the image member, first means for imagewise exposing the image member to create a first electrostatic image of the first polarity, first means for applying toner made up of toner particles having a charge of the first polarity to the first electrostatic image to create a first toner image defined by the first electrostatic image, second means for applying a uniform charge of a first polarity to the image member, second means for imagewise exposing the image member to create a second electrostatic image of the first polarity, and second means for applying a toner made up of toner particles charged to the first polarity to the second electrostatic image to create a second toner image, wherein image forming apparatus has a first mode in which said second means for applying a charge to the image member applies a charge to said image member and a second mode in which no charge is applied and in which said second means for imagewise exposing is not use, and said image forming apparatus includes means for applying a bias to said second means for applying a charge which bias is of the first polarity when the charging means is in its second mode to prevent accumulation of toner particles on the second charging means from the first toner image.

2. Image forming apparatus according to claim 1 wherein said second means for charging includes a corona generating means and a grid and said apparatus includes means for applying a voltage to each of said corona generating means and said grid and control means for controlling the voltage applied, said control means including means for reducing the voltage applied to said corona generating means to a level at which no corona is generated and means for maintaining a bias on said grid of the first polarity when said second charging means is in its second mode.

* * * * *